US005273396A

United States Patent [19]

Albrecht et al.

[11] Patent Number: 5,273,396

[45] Date of Patent: Dec. 28, 1993

[54] ARRANGEMENT FOR DEFINING IMPROVED COOLING AIRFLOW SUPPLY PATH THROUGH CLEARANCE CONTROL RING AND SHROUD

[75] Inventors: Richard W. Albrecht; Andrew Shepherd, both of Fairfield, Ohio

[73] Assignee: General Electric Company, Cincinnati, Ohio

[21] Appl. No.: 902,346

[22] Filed: Jun. 22, 1992

[51] Int. Cl.[5] ..... F01D 9/02

[52] U.S. Cl. ..... 415/173.1; 415/115; 415/173.6

[58] Field of Search ..... 415/115, 116, 170.1, 415/173.1, 173.6

[56] References Cited

U.S. PATENT DOCUMENTS

| | | | |
|---|---|---|---|
| 3,408,044 | 10/1968 | Burger | 253/39.1 |
| 3,583,824 | 6/1971 | Smuland | 415/173.1 |
| 4,302,148 | 11/1981 | Tubbs | 415/115 |
| 4,329,114 | 5/1982 | Johnston et al. | 415/145 |
| 4,642,024 | 2/1987 | Weidner | 415/116 |
| 4,820,116 | 4/1989 | Hovan et al. | 415/115 |
| 5,100,291 | 3/1992 | Glover | 415/116 |
| 5,165,847 | 11/1992 | Proctor et al. | 415/115 |
| 5,169,287 | 12/1992 | Proctor et al. | 415/115 |

*Primary Examiner*—Edward K. Look
*Assistant Examiner*—Mark Sgantzos
*Attorney, Agent, or Firm*—Jerome C. Squillaro

[57] ABSTRACT

A high pressure turbine in a gas turbine engine contains an arrangement of channels, holes and windows through components controlling the operating clearance between tips of turbine blades and casing shroud segments wherein the arrangement defines a serial supply path for a single cooling airflow through the clearance control components. The arrangement also includes a plurality of holes defined through a cover located between shroud holders and segments.

11 Claims, 2 Drawing Sheets

ARRANGEMENT FOR DEFINING IMPROVED COOLING AIRFLOW SUPPLY PATH THROUGH CLEARANCE CONTROL RING AND SHROUD

BACKGROUND OF THE INVENTION

1. Field of the Invention

The present invention relates generally to secondary cooling systems in gas turbine engines and, more particularly, to an improved arrangement defining a serial supply path for a single cooling airflow through the clearance control ring and turbine shroud of the engine.

2. Description of the Prior Art

A gas turbine engine of the turbofan type generally includes a forward fan, a middle core engine, and an aft low pressure power turbine. The core engine encompasses a compressor, a combustor and a high pressure turbine in a serial flow relationship. The compressor and high pressure turbine of the core engine are interconnected by a central shaft. The compressor is rotatably driven to compress air entering the core engine to a relatively high pressure. This high pressure air is then mixed with fuel in the combustor and ignited to form a high energy gas stream. This gas stream flows aft and passes through the high pressure turbine, rotatably driving it and the core engine shaft which, in turn, rotatably drives the compressor.

In the turbofan engine, the residual gas stream leaving the core engine high pressure turbine is expanded through a second turbine, which as mentioned above is the aft low pressure turbine. The aft low pressure turbine, in turn, drives the forward fan via a separate shaft which extends forwardly through the central shaft of the high pressure turbine rotor. Although some of the thrust is produced by the residual gas stream exiting the core engine, most of the thrust produced is generated by the forward fan.

It is common practice with respect to gas turbine engines to provide some form of cooling for the hot regions of the turbine engine. This cooling has mainly involved the use of air bled from the compressor of the engine which is then fed to the regions of the engine to be cooled. Thereafter, the air is allowed to rejoin the main gas flow of the engine.

The efficiency of a gas turbine engine is dependent upon many factors. One factor is the degree to which high pressure air generated by the compressor of the engine and intended primarily for driving the high pressure turbine after passage through the combustor is siphoned or bled off to other uses in the engine. One such use of bleed air is the cooling of the clearance control ring and shroud to achieve uniform operating clearance between the shroud and turbine blades. The greater the amount of high pressure air diverted to these other uses in the engine, the less the amount of air to drive the core turbine and thus the less efficiently the high pressure turbine will operate.

Currently, an arrangement is provided which defines separate airflow supply paths routing bleed air to the clearance control ring and the turbine shroud. This prior art arrangement requires a higher total flow of cooling air and results in a larger penalty on engine performance than is desirable. Consequently, a need exists for a more efficient arrangement for cooling the clearance control ring and shroud so as to minimize the penalty to engine performance.

SUMMARY OF THE INVENTION

The present invention provides an improved arrangement defining a serial supply path for a single cooling airflow through the clearance control ring and turbine shroud of the engine. The arrangement more efficiently utilizes a reduced total flow of cooling air and thereby improves engine performance.

Accordingly, the present invention is set forth in a gas turbine engine including a rotor rotatable about a longitudinal axis and having a row of blades with outer tips, a stationary casing disposed in concentric relation about the rotor, and a plurality of blade tip clearance control components, the components including a plurality of clearance control rings mounted on the casing and extending circumferentially about the axis, a plurality of shroud segments extending circumferentially about the outer tips of the blades, and a plurality of shroud holders extending circumferentially about the axis and supporting the shroud segments in radially outward spaced relation from the outer tips of the blades. The present invention is directed to an arrangement for cooling the clearance control components which comprises: means for defining a serial supply path for a single cooling airflow from a source thereof through the clearance control components. The serial supply path-defining means includes at least one channel defined through each clearance control ring, at least one hole defined through each clearance control ring and communicating with one shroud holder, at least one window defined in a top wall of each shroud holder, and at least one window defined in a cross wall of each shroud holder.

The arrangement further comprises at least one cover disposed between each shroud holder and shroud segment. The cover has a central recessed portion with holes formed therethrough to generate jets of cooling air for impinging on the shroud segments located below the cover. The cover also has a peripheral attachment portion connected to and surrounding the central recessed portion. The cover extends between and is attached to a pair of shoulders defined on lower portions of front, rear and side walls of each shroud holder.

These and other features and advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
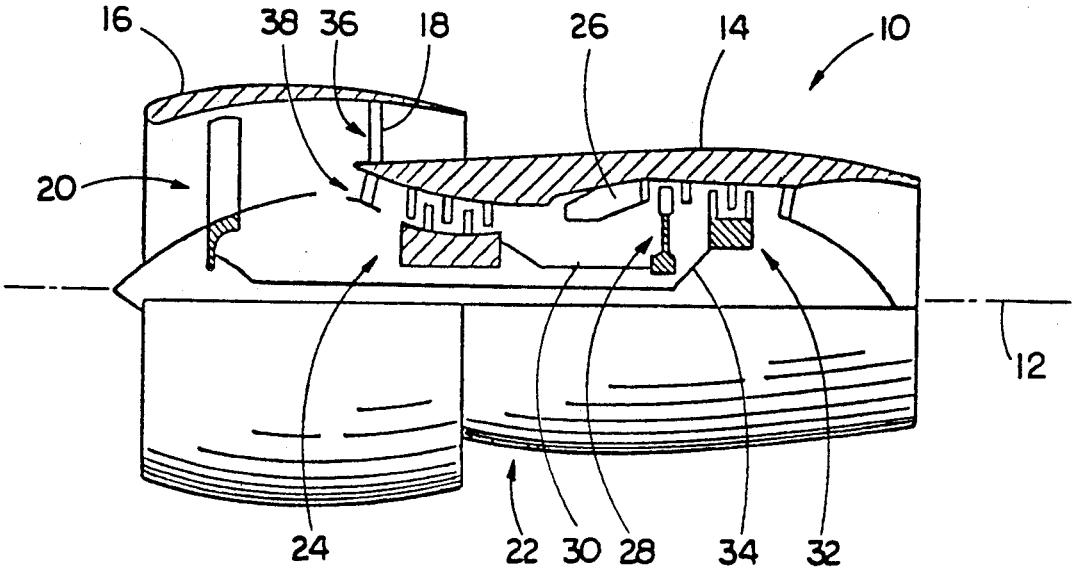
FIG. 1 (PRIOR ART)
FIG. 1 is a schematic representation of a prior art gas turbine engine.

In the following description, like reference characters designate like or corresponding parts throughout the several views. Also in the following description, it is to be understood that such terms as "forwardly", "rearward", "left", "right", "upwardly", "downwardly", and the like, are words of convenience and are not to be construed as limiting terms.

Prior Art Gas Turbine Engine

Figure 2:
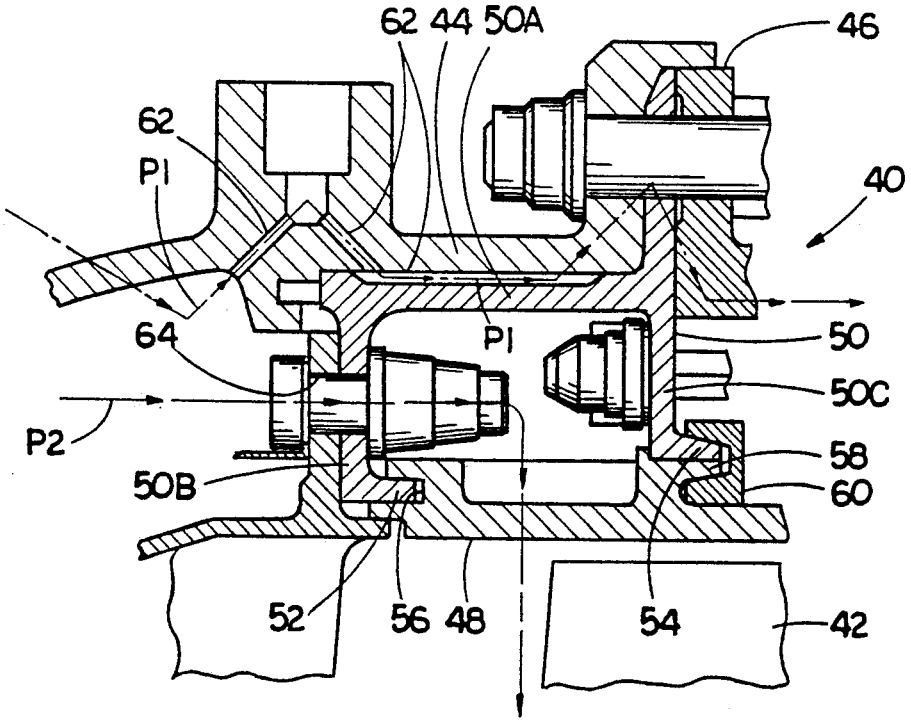
FIG. 2 (PRIOR ART)
FIG. 2 is a fragmentary enlarged longitudinal sectional view of a prior art arrangement defining separate supply paths for separate cooling airflows through the clearance control ring and turbine shroud of the engine.

Referring now to the drawings, and particularly to FIGS. 1 and 2, there is schematically illustrated a prior art gas turbine engine, being generally designated 10. The engine 10 has a longitudinal center line or axis 12 and an outer stationary annular casing 14 and nacelle 16 disposed coaxially and concentrically about the axis 12. The nacelle 16 is supported about the forward end of the casing 14 by a plurality of struts 18, only one of which being shown in FIG. 1.

The engine 10 includes a forward fan 20 disposed within the nacelle 16 and a core gas generator engine 22 disposed rearwardly of the fan 20 and within the stationary casing 14. The core engine 22 is composed of a multi-stage compressor 24, a combustor 26, and a high pressure turbine 28, either single or multiple stage, all arranged coaxially about the longitudinal axis of the engine 10 in a serial, axial flow relationship. An annular outer drive shaft 30 fixedly interconnects the compressor 24 and high pressure turbine 28. The engine 10 further includes a low pressure turbine 32 disposed rearwardly of the high pressure turbine 28. The low pressure turbine 32 is fixedly attached to an inner drive shaft 34 which, in turn, is connected to the forward fan 20. Conventional bearings and the like have been omitted from FIG. 1 for the sake of clarity.

In operation, air enters the gas turbine engine 10 through an air inlet of the nacelle 16 surrounding the forward fan 20. The air is compressed by rotation of the fan 20 and thereafter is split between an outer annular passageway 36 defined between the nacelle 16 and the engine casing 14, and a core engine passageway 38 having its external boundary defined by the engine casing 14. The pressurized air entering the core engine passageway 38 is further pressurized by the compressor 24. Pressurized air from the compressor 24 is mixed with fuel in the combustor 26 and ignited, thereby generating combustion gases. Some work is extracted from these gases by the high pressure turbine 28 which drives the compressor 24. The remainder of the combustion gases are discharged from the core engine 22 into the low pressure power turbine 32 to drive the forward fan 20. The portion of the air flow provided from the fan 20 through the outer passageway 36 produces the main propulsive thrust generated by the engine 10.

Prior Art Airflow Supply Arrangement

Referring to FIG. 2, the high pressure turbine 38 of the engine 10 has components, generally designated 40, which define the operating clearance between the engine casing 14 and the tips of the turbine blades 42. The clearance-defining components 40 include a plurality of clearance control rings 44 mounted on a circumferential flange 46 of the casing 14 and aligned in a circumferential direction about the axis 12 (FIG. 1), a plurality of shroud segments 48 circumferentially aligned with one another, and a plurality of inverted Unshaped shroud hangers or holders 50 (only one shown) aligned circumferentially and mounted to the clearance control rings 44 and supporting the shroud segments 48 (only one shown) in radially outward spaced relation from the tips of the turbine blades 42 (only one shown). The shroud holder 50 has an axially-extending top wall 50A and a pair of transversely-extending front and rear walls 50B, 50C attached to and extending radially inwardly from the front and rear edges of the top wall 50A. Along the lower ends of its respective front and rear walls 50B, 50C, the shroud holder 50 has flanges 52, 54 which are axially spaced from one another. The front wall flange 52 of the shroud holder 50 mates within a forwardly-facing groove 56 defined in the front edge of the shroud segment 48. The rear wall flange 54 of the shroud holder 50 and a flange 58 on the rear edge of the shroud segment 48 are held in clamped engagement with one another by a C-shaped locking member 60 slidably mounted over the shroud segment flange 58 and shroud holder rear wall flange 54.

For uniformly cooling the above-described components 40 defining the turbine blade tip operating clearance, high pressure air is bled from an intermediate stage of the multi-stage compressor 24 and routed to the components 40 via a prior art arrangement in the form of channels 62 and holes 64 defining two separate supply paths $P_1$, $P_2$ for providing separate cooling airflows through the clearance control rings 44 and the shroud segments 48 and holders 50. As mentioned earlier, this prior art arrangement requires a higher total flow of cooling air and results in a larger penalty on engine performance than is desirable.

Airflow Supply Arrangement of the Invention

Figure 3:
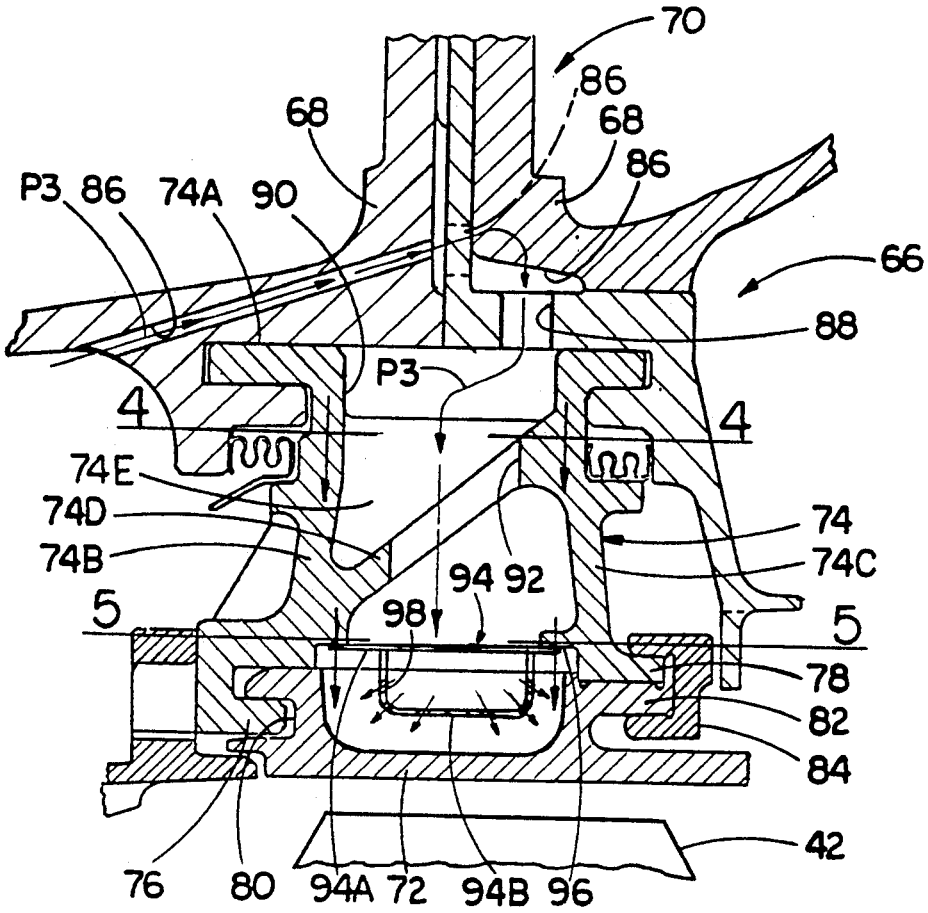
FIG. 3 is a fragmentary enlarged longitudinal sectional view of an improved arrangement of the present invention defining a serial supply path for a single cooling airflow through the clearance control ring and turbine shroud of the engine.
Figure 4:
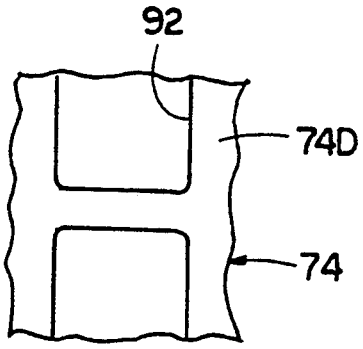
FIG. 4 is a fragmentary circumferential sectional view taken along line 4—4 of FIG. 3.
Figure 5:
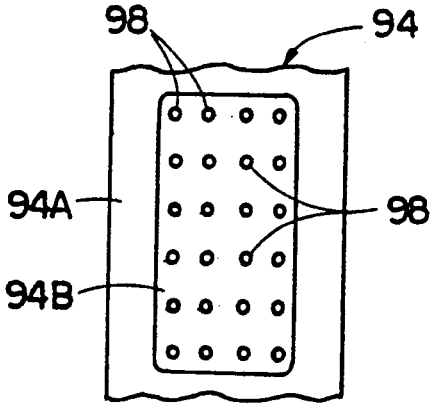
FIG. 5 is a fragmentary circumferential sectional view taken along line 5—5 of FIG. 3.

Referring to FIGS. 3-5, the amount of high pressure air bled from the intermediate stage of the compressor 24 is held to a minimum by employment of an improved arrangement of the present invention which defines a serial supply path $P_3$ for a single cooling airflow through the components, generally designated 66, which define the operating clearance between the engine casing 14 and the tips of the turbine blades 42. The clearance-defining components 66 are generally similar to the components 40 described above. Thus, the components 66 include a plurality of clearance control rings 68 mounted on a circumferential flange 70 of the casing 14 and aligned in a circumferential direction about the axis 12 (FIG. 1), a plurality of shroud segments 72 aligned in a circumferential direction with one another, and a plurality of shroud hangers or holders 74 (only one shown) aligned in a circumferential direction with one another and mounted to the clearance control rings 68 and supporting the shroud segments 72 (only one shown) in radially outward spaced relation from the tips of the turbine blades 42 (only one shown).

The shroud holder 74 has an axially-extending top wall 74A and a pair of transversely-extending front and rear walls 74B, 74C attached to and extending radially inwardly from the front and rear edges of the top wall 74A. Front and rear walls 74B and 74C, respectively, are attached to and extend circumferentially between a pair of side walls 74E (only one of which is shown in FIG. 3). Along lower ends of its respective front and rear walls 74B, 74C, the shroud holder 74 has flanges 76, 78 which are axially spaced from one another. The front wall flange 76 of the shroud holder 74 mates within a forwardly-facing groove 80 defined in the front edge of the shroud segment 72. The rear wall flange 78 of the shroud holder 74 and a flange 82 on the rear edge of the shroud segment 72 are held in clamped engagement with one another by a C-shaped locking member 84 slidably mounted over the shroud segment rear flange 82 and shroud holder rear wall flange 78.

For uniformly cooling the above-described components 66 defining the turbine blade tip operating clearance, high pressure air is bled from an intermediate stage of the multi-stage compressor 24 and routed to the components 66 via the arrangement in the form of channels 86 in the casing circumferential flange 70, holes 88 in the clearance control rings 68 of the casing flange 70, and windows 90, 92 in the top wall 74A of the shroud holder 74 and in a cross wall 74D thereof extending diagonally between lower and upper ends of opposite front and rear walls 74B, 74C of the shroud holder 74. The arrangement of channels 86, holes 88, and windows 90, 92 define the serial supply path $P_3$ for the single cooling airflow through the clearance control rings 68 and the shroud segments 72 and holders 74.

The arrangement also includes a plurality of covers 94 (only one being shown) disposed below the cross wall 74D and extending between and attached to the front and rear walls 74B, 74C of the shroud holder 74 against a pair of axially-spaced shoulders 96 defined thereon, and attached to a lower edge of each side wall 74E. The cover 94 has a peripheral attachment portion 94A surrounding a plurality of central recessed portions 94B having holes 98 formed therethrough to generate streams or jets of cooling air which provides impingement and/or film cooling of the shroud segments 72 located below the covers 94.

The advantages of the arrangement defining the serial supply airflow path $P_3$ through the components 66 and cover 94 are: (1) a reduced total cooling flow and improved engine performance; (2) minimized pressure loss of airflow through the shroud holders 74 due to the large size of the windows 90, 92 therethrough; (3) metering of airflow by the channels 86 in the clearance control rings 68; and (4) further cooling of air as it passes through the clearance control rings 68 which improves cooling of the shroud segments 72.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

We claim:

1. In a gas turbine engine including a rotor rotatable about a longitudinal axis and having a row of blades with outer tips, a stationary casing disposed in concentric relation about said rotor, and a plurality of blade tip clearance control components, said clearance control components including a plurality of clearance control rings mounted on said casing and extending circumferentially about said axis, a plurality of shroud segments extending circumferentially about said outer tips of said blades, and a plurality of shroud holders extending circumferentially about said axis and supporting said shroud segments in radially outward spaced relation from said outer tips of said blades, an arrangement for cooling said clearance control components, comprising:

(a) means for defining a serial supply path for a single cooling airflow through said clearance control components;

(b) wherein said serial supply path-defining means includes at least one channel defined through each of said clearance control rings, wherein said clearance control rings are radially spaced apart from said shroud segments by said shroud holders which are mounted on said clearance control rings.

2. The arrangement as recited in claim 1, wherein:

said serial supply path-defining means includes at least one hole defined through each of said clearance control rings and communicating with one of siad shroud holders, said at least one hole being positioned downstream of said at least one channel;

said at least one channel meters the single cooling airflow through said serial supply path-defining means.

3. The arrangement as recited in claim 2 wherein:

each of aid shroud holders has a top wall, a front wall and a rear wall; and said serial supply path-defining means includes at least one window defined in said top wall of each of said shroud holders, wherein said at least one window is positioned downstream of said at least one hole and is sized so as to minimize a pressure loss of the single cooling airflow through a corresponding one of said shroud holders.

4. The arrangement as recited in claim 2, wherein:

each of said shroud holders has a front wall, a rear wall and a cross wall extending between and interconnecting said front and rear walls; and said serial supply path-defining means includes at least one window defined in said cross wall of each of said shroud holders, wherein said at least one window is positioned downstream of said at least one hole and is sized so as to minimize a pressure loss of the single cooling airflow through a corresponding one of said shroud holders.

5. The arrangement as recited in claim 4, further comprising:

at least one cover disposed between said each shroud holder and shroud segment, siad cover having a central portion with holes formed therethrough to generate jets of cooling air for impinging on said shroud segments located below said cover.

6. The arrangement as recited in claim 5, wherein said cover includes:

a central recessed portion containing siad holes; and a peripheral attachment portion connected to and surrounding said central recessed portion.

7. The arrangement as recited in claim 5, wherein:

said cover extends between and is attached to a pair of shoulders defined on lower potions of said front and rear walls.

8. In a gas turbine engine including a plurality of blade tip clearance control components extending in circumferential relation about a longitudinal axis of said engine, said components including a plurality of circumferntially-extending clearance control rings, a plurality of circumferentially-extending shroud segments and a plurality of circumferentially-extending shroud holders supporting said shroud segments, an arrangement for cooling said clearance control components, comprising:

(a) means for defining a serial supply path for a single cooling airflow through said clearance control components;

(b) said serial supply path-defining means including at least one channel defined through each of said clearance control rings, at last one window defined through each of said shroud holders, and at least one cover disposed between each of said shroud holders and shroud segments, said cover having a plurality of holes formed therethrough to generate jets of cooling air for impinging said shroud segments located below said cover, wherein said clearance control rings are radially spaced apart from said shroud segments by said shroud holders and wherein said shroud holders are separable from said clearance control rings and said shroud segments.

9. The arrangement as recited in claim 8, wherein:

each of said shroud holders has a front wall, a rear wall, and a top wall and cross wall extending between and interconnecting said front and rear walls; and said serial supply path-defining means includes at least one said window defined in each of said top wall and cross wall of each of said shroud holders and at least one hole defined through each of said clearance control rings and positioned intermediate said at least one channel of a corresponding one of said clearance control rings and said at least one window of said top wall;

said at least one channel meters the single cooling airflow through said serial supply path-defining means and said at least one window in said top wall and said at least one window in said cross wall are sized so as to minimize a pressure loss of the single cooling airflow through a corresponding one of said shroud holders.

10. The arrangement as recited in claim 8, wherein said cover includes:

a central recessed portion containing said holes; and a peripheral attachment portion connected to and surround said central recessed portion.

11. The arrangement as recited in claim 8, wherein:

each of said shroud holders has a front wall and a rear wall; and said cover extends between and is attached to a pair of shoulders defined on lower portions of said front and rear walls.

* * * * *